US010301891B2

(12) United States Patent
Derkacz et al.

(10) Patent No.: US 10,301,891 B2
(45) Date of Patent: May 28, 2019

(54) JIG FOR COUPLING OR UNCOUPLING DRILL STRING SECTIONS WITH DETACHABLE COUPLINGS AND RELATED METHODS

(71) Applicant: EVOLUTION ENGINEERING INC., Calgary (CA)

(72) Inventors: Patrick R. Derkacz, Calgary (CA); Aaron W. Logan, Calgary (CA); Justin C. Logan, Calgary (CA)

(73) Assignee: Evolution Engineering Inc., Calgary (CA)

( * ) Notice: Subject to any disclaimer, the term of this patent is extended or adjusted under 35 U.S.C. 154(b) by 169 days.

(21) Appl. No.: 15/306,044

(22) PCT Filed: May 8, 2015

(86) PCT No.: PCT/CA2015/050419

§ 371 (c)(1),
(2) Date: Oct. 21, 2016

(87) PCT Pub. No.: WO2015/168805

PCT Pub. Date: Nov. 12, 2015

(65) Prior Publication Data

US 2017/0044853 A1 Feb. 16, 2017

Related U.S. Application Data

(60) Provisional application No. 62/014,536, filed on Jun. 19, 2014, provisional application No. 61/990,244, filed on May 8, 2014.

(51) Int. Cl.

| | |
|---|---|
| ***E21B 3/04*** | (2006.01) |
| ***E21B 19/16*** | (2006.01) |
| ***E21B 17/042*** | (2006.01) |

(52) U.S. Cl.
CPC ..... *E21B 19/16* (2013.01); *E21B 17/042* (2013.01); *E21B 19/161* (2013.01); *E21B 19/167* (2013.01); *E21B 3/04* (2013.01)

(58) Field of Classification Search
CPC ..... E21B 16/16; E21B 16/161; E21B 16/167; E21B 17/042; E21B 3/04
See application file for complete search history.

(56) References Cited

U.S. PATENT DOCUMENTS 2,112,108 A 3/1938 MacKenzie
2,243,272 A * 5/1941 Delbert ..... E21B 19/161 81/99

(Continued)

FOREIGN PATENT DOCUMENTS

CA 2502154 A1 10/2005
CA 2510435 A1 12/2005

(Continued)

*Primary Examiner* — Jennifer H Gay
(74) *Attorney, Agent, or Firm* — Oyen Wiggs Green & Mutala LLP

(57) ABSTRACT

A jig and method useful for coupling and/or uncoupling drill string sections. In some embodiments, the jig comprises a body having an outer surface for engaging a torqueing tool and a cavity extending from a first end to a second end of the body and an engagement means at the first end of the body. The engagement means may be dimensioned to non-rotationally engage an outer surface of a first end of a drill string section and the cavity may be sized to fit about a drill string section.

9 Claims, 11 Drawing Sheets

(56) References Cited

U.S. PATENT DOCUMENTS 2,295,720 A * 9/1942 Dietzmann ..... E21B 19/16 166/77.51
3,094,852 A * 6/1963 Taylor ..... E21B 19/10 138/142
3,380,324 A * 4/1968 Hillman ..... E21B 19/16 173/164
3,434,191 A * 3/1969 Archie ..... E21B 17/00 166/77.53
3,463,247 A * 8/1969 Klein ..... E21B 19/10 166/77.53
3,768,579 A * 10/1973 Klein ..... E21B 19/167 173/164
3,915,243 A * 10/1975 Hisey ..... E21B 3/04 173/147
3,980,143 A * 9/1976 Swartz ..... E21B 19/20 166/377
4,023,449 A * 5/1977 Boyadjieff ..... E21B 19/10 81/57.16
4,147,215 A * 4/1979 Hodge ..... E21B 19/16 166/380
4,194,579 A * 3/1980 Bailey ..... E21B 19/167 173/164
4,240,652 A 12/1980 Wong et al.
4,335,602 A 6/1982 Walkow
4,445,265 A 5/1984 Olson et al.
4,496,174 A 1/1985 McDonald et al.
4,520,468 A 5/1985 Scherbatskoy
4,658,915 A 4/1987 Goris et al.
4,693,317 A 9/1987 Edwards et al.
4,844,171 A * 7/1989 Russell, Jr. ..... E21B 19/167 166/377
5,267,621 A * 12/1993 Deken ..... E21B 3/02 175/320
5,544,712 A * 8/1996 McEwen ..... E21B 19/167 166/377
5,740,860 A 4/1998 Crawford et al.
5,817,937 A 10/1998 Beshoory et al.
5,996,712 A 12/1999 Boyd
6,098,727 A 8/2000 Ringgenberg et al.
6,305,723 B1 10/2001 Schutz et al.
6,488,323 B1 * 12/2002 Bouligny ..... B66C 1/46 269/22
6,499,541 B1 12/2002 Hiron et al.
6,845,826 B1 1/2005 Feld et al.
7,252,160 B2 8/2007 Dopf et al.
7,255,183 B2 8/2007 Cramer
7,387,167 B2 6/2008 Fraser et al.
7,390,032 B2 6/2008 Hughes
7,543,650 B2 * 6/2009 Richardson ..... E21B 17/06 166/379
8,258,976 B2 9/2012 Price et al.
8,308,199 B2 11/2012 Camwell et al.
8,376,065 B2 2/2013 Teodorescu et al.
8,400,160 B2 3/2013 Fredette et al.
8,407,006 B2 3/2013 Gleitman
8,648,733 B2 2/2014 Dopf et al.
8,695,727 B2 4/2014 Chau et al.
8,704,677 B2 4/2014 Prammer
2004/0226753 A1 11/2004 Villareal
2005/0167157 A1 8/2005 Boyadjieff
2006/0089804 A1 4/2006 Chen et al.
2006/0225891 A1 * 10/2006 Adams ..... E21B 19/002 166/382
2007/0063513 A1 * 3/2007 Boyd ..... E21B 17/04 285/355
2008/0191900 A1 8/2008 Camwell et al.
2010/0032210 A1 2/2010 Teodorescu et al.
2010/0263495 A1 * 10/2010 Webb ..... E21B 19/164 81/57.33
2011/0120269 A1 5/2011 McCormick et al.
2011/0180273 A1 7/2011 Hughes et al.
2011/0254695 A1 10/2011 Camwell et al.
2012/0067649 A1 3/2012 Wlson
2012/0085583 A1 4/2012 Logan
2012/0137833 A1 * 6/2012 Pettit ..... E21B 19/161 81/57.11
2013/0032412 A1 2/2013 Haugvaldstad et al.
2013/0120154 A1 5/2013 Gleitman
2014/0083773 A1 3/2014 Minosyan et al.
2014/0131051 A1 * 5/2014 Pratt ..... E21B 19/06 166/380
2014/0131994 A1 5/2014 Holmen et al.
2014/0150544 A1 6/2014 Logan et al.
2015/0114634 A1 * 4/2015 Limbacher ..... E21B 47/04 166/255.1
2017/0044853 A1 * 2/2017 Derkacz ..... E21B 19/167
2017/0101829 A1 * 4/2017 Heide ..... E21B 17/046

FOREIGN PATENT DOCUMENTS

CA 2570344 A1 12/2005
CA 2586317 A1 10/2007
CA 2699023 A1 10/2010
CA 2796683 A1 5/2013
GB 2404401 A 2/2005
GB 2470286 A 11/2010
WO 0109478 A1 2/2001
WO 2010121345 A1 10/2010
WO 2014031663 A1 10/2010
WO 2011049573 A1 4/2011
WO 2013037058 A1 3/2013
WO 2014066972 A1 5/2014
WO 2014075190 A1 5/2014

* cited by examiner

JIG FOR COUPLING OR UNCOUPLING DRILL STRING SECTIONS WITH DETACHABLE COUPLINGS AND RELATED METHODS

TECHNICAL FIELD

This application relates to a jig for use in torqueing drill string sections and methods therefor. In particular, this application relates to a jig and methods for coupling and decoupling drill string sections with interchangeable connectors.

BACKGROUND

Recovering hydrocarbons from subterranean zones typically involves drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid, usually in the form of a drilling "mud", is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at surface.

Bottom hole assembly (BHA) is the name given to the equipment at the terminal end of a drill string. In addition to a drill bit, a BHA may comprise elements such as: apparatus for steering the direction of the drilling (e.g. a steerable downhole mud motor or rotary steerable system); sensors for measuring properties of the surrounding geological formations (e.g. sensors for use in well logging); sensors for measuring downhole conditions as drilling progresses; one or more systems for telemetry of data to the surface; stabilizers; heavy weight drill collars; pulsers; and the like. The BHA is typically advanced into the wellbore by a string of metallic tubulars (drill pipe).

Modern drilling systems may include any of a wide range of mechanical/electronic systems in the BHA or at other downhole locations. Such electronics systems may be packaged in a specialized sub that couples into a drill string. A downhole system may comprise any active mechanical, electronic, and/or electromechanical system that operates downhole. A downhole system may provide any of a wide range of functions including, without limitation: data acquisition; measuring properties of the surrounding geological formations (e.g. well logging); measuring downhole conditions as drilling progresses; controlling downhole equipment; monitoring status of downhole equipment; directional drilling applications; measuring while drilling (MWD) applications; logging while drilling (LWD) applications; measuring properties of downhole fluids; and the like. A downhole system may comprise one or more systems for: telemetry of data to the surface; collecting data by way of sensors (e.g. sensors for use in well logging) that may include one or more of vibration sensors, magnetometers, inclinometers, accelerometers, nuclear particle detectors, electromagnetic detectors, acoustic detectors, and others; acquiring images; measuring fluid flow; determining directions; emitting signals, particles or fields for detection by other devices; interfacing to other downhole equipment; sampling downhole fluids; etc. Some downhole systems are highly specialized and expensive.

A downhole system may communicate a wide range of information to the surface by telemetry. Telemetry information can be invaluable for efficient drilling operations. For example, telemetry information may be used by a drill rig crew to make decisions about controlling and steering the drill bit to optimize the drilling speed and trajectory based on numerous factors, including legal boundaries, locations of existing wells, formation properties, hydrocarbon size and location, etc. A crew may make intentional deviations from the planned path as necessary based on information gathered from downhole sensors and transmitted to the surface by telemetry during the drilling process. The ability to obtain and transmit reliable data from downhole locations allows for relatively more economical and more efficient drilling operations.

There are several known telemetry techniques. These include transmitting information by generating vibrations in fluid in the bore hole (e.g. acoustic telemetry or mud pulse (MP) telemetry) and transmitting information by way of electromagnetic signals that propagate at least in part through the earth (EM telemetry). Other telemetry techniques use hardwired drill pipe, fibre optic cable, or drill collar acoustic telemetry to carry data to the surface.

Drill string components are typically coupled together by screwing together threaded couplings to very high torques. This is often accomplished through the use of power tongs which grip and then turn the drill string sections. Subs containing downhole electronic or electromechanical systems may be susceptible to damage when they are incorporated into a drill string. For example, such subs may have thinner walls than drill collars and may be damaged by power tongs. There is a need for tools and methods for safely coupling subs containing downhole systems into drill strings.

SUMMARY

The following embodiments and aspects thereof are described and illustrated in conjunction with systems, tools, and methods which are meant to be exemplary and illustrative, not limiting in scope. In various embodiments, one or more of the above-described problems have been reduced or eliminated, while some embodiments are directed to other improvements.

Aspects of the invention provide apparatus and methods for torqueing a sub to couple to a drill string.

One aspect of the invention provides a method for torqueing a sub to couple or uncouple the sub to a drill string. In some embodiments, the sub may comprise a body having a first coupling at a first end thereof and a second coupling at a second end thereof opposed to the first end.

In some embodiments, torqueing a sub to couple or uncouple the sub to a drill string may comprise coupling a jig to the first coupling of the sub. The jig may non-rotationally engage the first coupling. A first torqueing tool may be engaged to an uphole end of a drill string and a second torqueing tool may be engaged to an outer surface of the jig and, using one or both of the first and second torqueing tools, the jig and the first coupling may be rotated relative to the drill string to couple the sub to or uncouple the sub from the uphole end of the drill string.

In some embodiments the jig comprises a body having a cylindrical outer surface and defines a cavity such that coupling the jig to the first coupling of the sub comprises introducing at least part of the body of the sub into the cavity of the jig.

In some embodiments, coupling the jig to the first coupling of the sub comprises engaging opposed flats of the jig to opposed flats on the first coupling of the sub.

In some embodiments, the first coupling of the sub is removable from the body of the sub.

In some embodiments, the sub is coupled to the drill string and an additional drill string segment is coupled to the second coupling of the sub.

In some embodiments, coupling the additional drill string segment to the second coupling of the sub comprises non-rotationally engaging a wrench to the second coupling of the sub, coupling the wrench to the first torqueing tool, engaging the additional drill string segment with the second torqueing tool and using one or both of the first and second torqueing tools, rotating the additional drill string segment relative to the second coupling of the sub to couple the additional drill string segment to or uncouple the additional drill string segment from the sub.

In some embodiments, the body of the sub is subjected to substantially no torque while rotating the additional drill string segment relative to the second coupling of the sub.

In some embodiments, the first torqueing tool comprises a rotary table.

In some embodiments, the second torqueing tool comprises a rotary table.

In some embodiments, the second coupling of the sub is removable from the body of the sub.

In some embodiments, the body of the sub is subjected to substantially no torque while rotating the jig and the first coupling relative to the drill string.

Another aspect of the invention provides a jig useful for coupling and/or uncoupling drill string sections. In some embodiments, the jig comprises a body having an outer surface for engaging a torqueing tool and a cavity extending from a first end to a second end of the body and an engagement means at the first end of the body. The engagement means may be dimensioned to non-rotationally engage an outer surface of a first end of a drill string section and the cavity may be sized to fit about a drill string section.

In some embodiments, the engagement means comprises a pair of opposed flats.

In some embodiments, the engagement means comprises a plurality of flats.

In some embodiments, the engagement means comprises an array of flats arranged to non-rotationally engage a periphery of a square or hexagonal shape.

In some embodiments, the engagement means comprises a first plurality of apertures and a corresponding first plurality of pins dimensioned to pass through the apertures to engage corresponding recesses in the drill string section.

In some embodiments, the outer surface of the body is cylindrical, the cavity is formed by a longitudinal groove in the body.

In some embodiments, the outer surface of the body subtends an angle greater than 180 degrees relative to a longitudinal centerline of the body.

In some embodiments, the body of the jig is U-shaped in cross-section.

In some embodiments, the jig may be used in combination with a wrench comprising a U-shaped body having an inner surface sized to fit about and non-rotationally engage a drill string section. The wrench may comprise a first aperture and a second aperture positioned at opposed ends of the U-shaped body and a latch engageable with the first and second apertures, the latch extending from the first aperture to the second aperture when the latch engages the first and second apertures.

In addition to the exemplary aspects and embodiments described above, further aspects and embodiments will become apparent by reference to the drawings and by study of the following detailed description.

BRIEF DESCRIPTION OF THE DRAWINGS

The accompanying drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Figure 1:
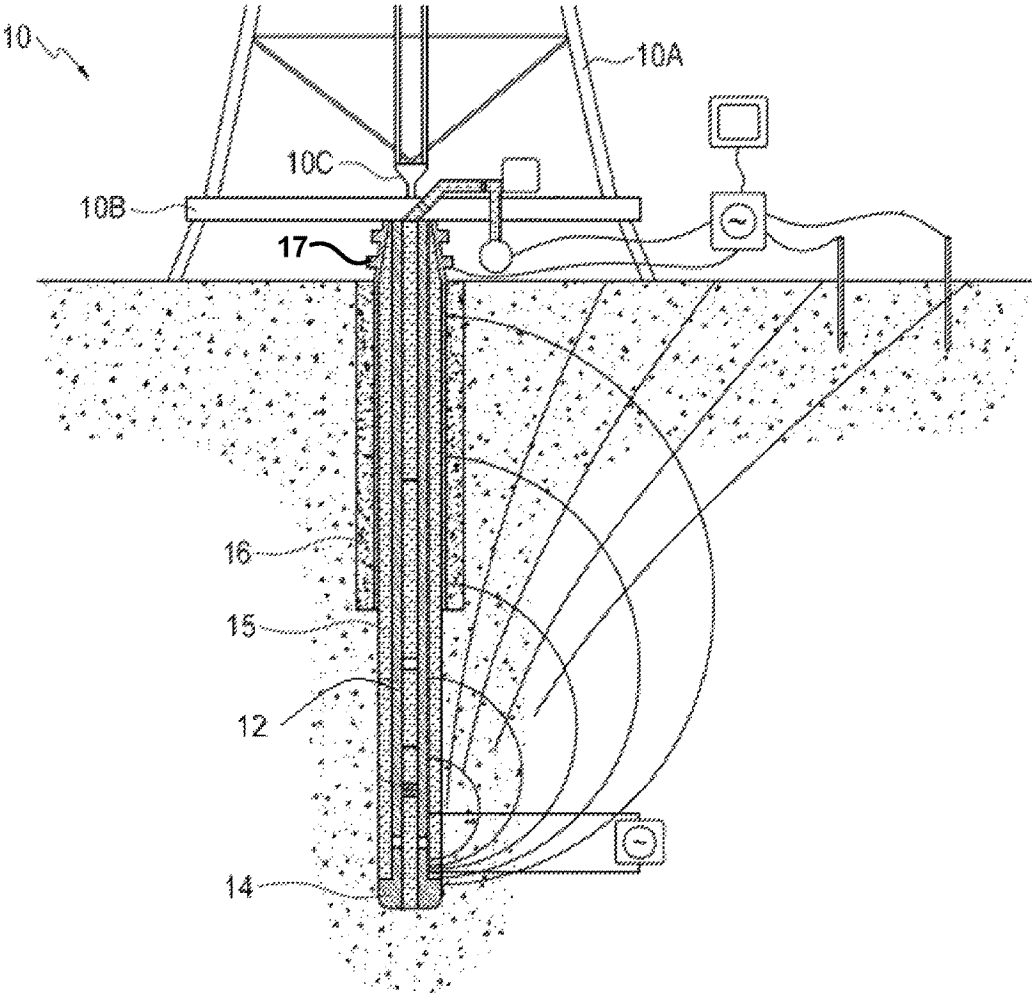
FIG. 1 is a schematic view of a drilling operation.

FIG. 1 shows schematically an example drilling operation. A drill rig 10 drives a drill string 12 which includes sections of drill pipe that extend to a drill bit 14. The illustrated drill rig 10 includes a derrick 10A, a rig floor 10B, and draw works 10C for supporting the drill string. Drill bit 14 is larger in diameter than the drill string above the drill bit. An annular region 15 surrounding the drill string is typically filled with drilling fluid. The drilling fluid is pumped through a bore in the drill string to the drill bit and returns to the surface through annular region 15 carrying cuttings from the drilling operation. As the well is drilled, a casing 16 may be made in the well bore. A blow out preventer 17 is supported at a top end of the casing. The drill rig illustrated in FIG. 1 is an example only. The methods and apparatus described herein are not specific to any particular type of drill rig.

Figure 2:
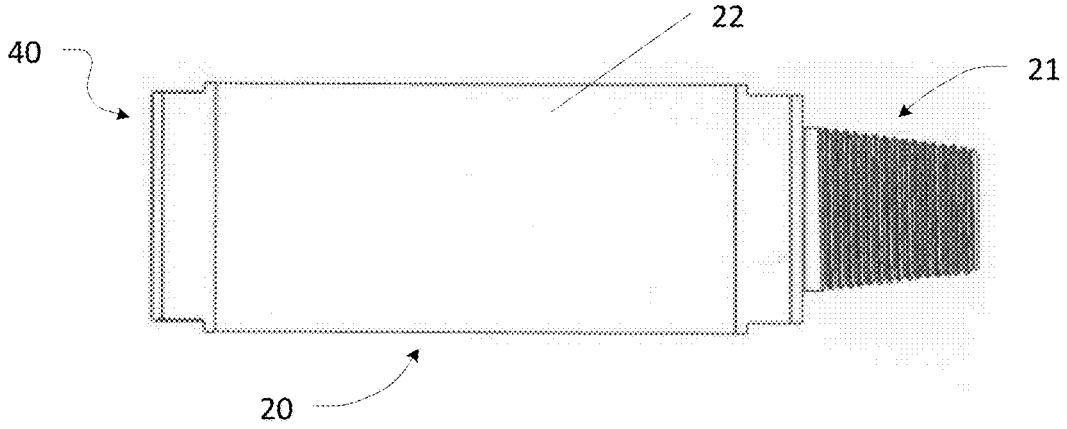
FIG. 2 is a side elevation view of a section of drill pipe according to an example embodiment of the invention.

FIG. 2 shows an example sub 20 including a pin 21, a box 40, and a body 22. Any of a wide range of downhole systems may be provided in compartments within sub 20.

Sub 20 may be coupled into a drill string by coupling pin 21 and box 40 to adjacent drill string sections. In some cases, it may be desirable to avoid rough handling of the body 22 of sub 20 between pin 21 and box 40. For example, body 22 may have walls thinner than normally provided in drill collars to provide room for one or more downhole systems. To facilitate handling sub 20 without damage while coupling sub 20 to or uncoupling sub 20 from a drill string, sub 20 provides tool engagement features adjacent to one or both of box 40 and pin 21. These tool engagement features are configured to transmit torque to sub 20 from a jig or wrench that can, in turn, be gripped by a power tong, a rotary table, or other torqueing tool. Torque can be applied directly to a coupling (e.g. pin 21 or box 40) by way of the tool engagement features. This permits torqueing of sub 20 without risking damage to sub 20 that could otherwise occur as a result of the power tong, rotary table, or other torqueing tool applying clamping force and/or torque directly to body 22. Torque can be applied directly to box 40 or pin 21.

Figure 3:
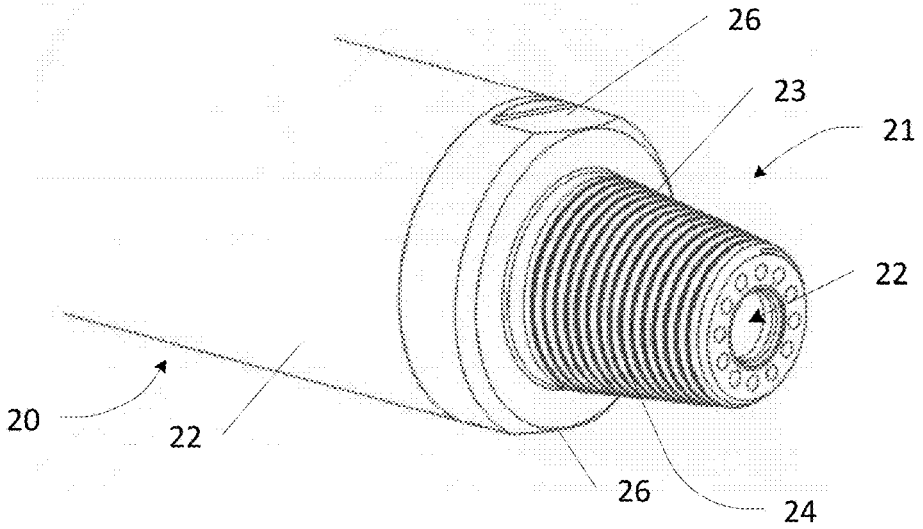
FIG. 3 is a partial isometric view of the pin shown in FIG. 2.
Figure 4:
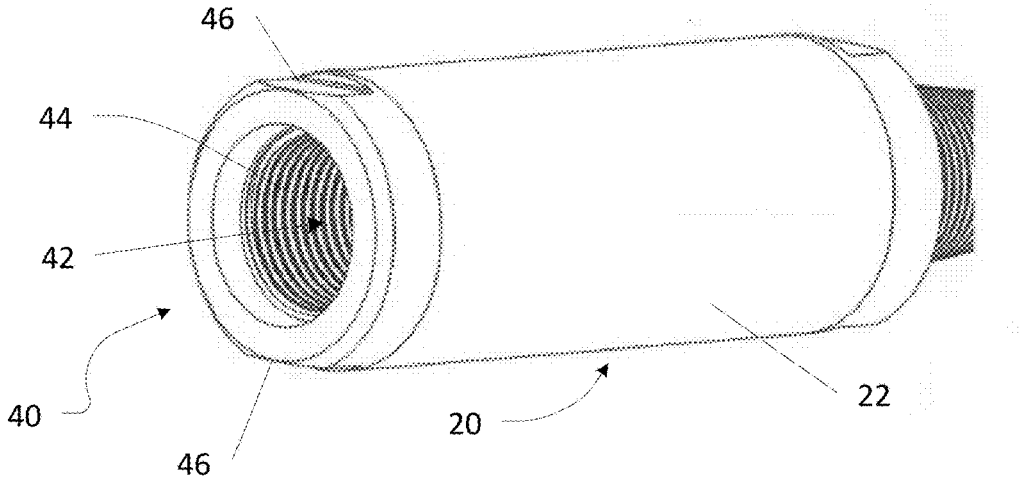
FIG. 4 is a partial isometric view of the box shown in FIG. 2.

In the embodiment illustrated in FIGS. 2 to 4, pin 21 and box 40 comprise opposed flats 26 and 46, respectively, defined in the outer circumference of each of pin 21 and box 40 at a proximal end thereof proximate to body 22. In other embodiments, pin 21 and/or box 40 may comprise pairs of opposed flats, a square or hexagonal array of flats around the outer circumference of pin 21 and/or box 40, or any other tool engagement means commonly used in the art, for example a pinned engagement.

In some embodiments, pin 21 and/or box 40 are provided on components that are detachable from body 22. Removing one or both of these components may provide access to an electronics package or other equipment inside sub 20 and may optionally provide a way to replace pin 21 and/or box 40. Replacing pin 21 and/or box 40 may be done to replace damaged couplings and/or to change one or both couplings to couplings of different types (for example, to permit sub 20 to be coupled to a specific drill string component).

In some such embodiments, one or both of the component carrying pin 21 and the component carrying box 40 may be threadedly coupled to body 22. In such cases, applying torque to sub 20 by way of the tool engagement faces on the component carrying the box or pin being coupled into the drill string avoids the risks of over torqueing the connection between pin 21 or box 40 and body 22 or detaching pin 21 or box 40 from body 22 while trying to couple or uncouple sub 20 from a drill string.

FIG. 3 shows pin 21 in greater detail. Pin 21 is connected to body 22 by a connection (not shown). A bore 22 extends through pin 21.

Pin 21 may be connected to body 22 by, for example, a threaded connection. In other embodiments, pin 21 may be connected to body 22 by another connection commonly used in the art, for example, a pinned connection.

In the illustrated embodiment, pin 21 comprises a tapered protrusion 23 having male threads 24 therearound. Threads 24 may correspond to female threads on a particular type of threaded coupling used on a particular section of drill string to which it is desired to attach sub 20. A set of different interchangeable pins 21 may be provided, each with different threads 24 for coupling to a different type of threaded coupling, wherein threads 24 match the threaded connection used to connect pin 21 to body 22. Threads 24 of different pins 21 may have different diameter, taper, pitch, cross-sectional shape, etc. Threads 24 may be API threads, ACME threads, etc.

Pin 21 may be replaced if it becomes damaged (e.g. if threads 24 become overly worn or otherwise damaged) by uncoupling pin 21 from body 22. Pin 21 may be made of a material that is resistant to galling (e.g. beryllium copper) for enhanced wear-resistance.

FIG. 4 shows box 40 in greater detail. Box 40 may be attached removably to body 22 by a suitable connection (not shown). A bore 42 passes through box 40.

Box 40 may be connected to body 22 by, for example, a threaded connection. In other embodiments, box 40 may be connected to body 22 by another connection commonly used in the art, for example, a pinned connection.

In the illustrated embodiment, the surface of box 40 defining bore 42 comprises threads 44. Threads 44 may correspond to a particular type of threaded coupling used on a particular section of drill string to which it is desired to attach sub 20. A set of different interchangeable boxes 40 may be provided, each with different threads 44 for coupling to a different type of threaded coupling, wherein threads 44 matches the threaded connection used to connect box 40 to body 22. Threads 44 of different boxes 40 may have different diameter, taper, pitch, cross-sectional shape, etc. Threads 44 may be API threads, ACME threads, etc.

Box 40 may be replaced if it becomes damaged (e.g. if threads 44 become overly worn or otherwise damaged) by uncoupling box 40 from body 22. Box 40 may be made of a material that is resistant to galling (e.g. beryllium copper) for enhanced wear-resistance.

Figure 5:
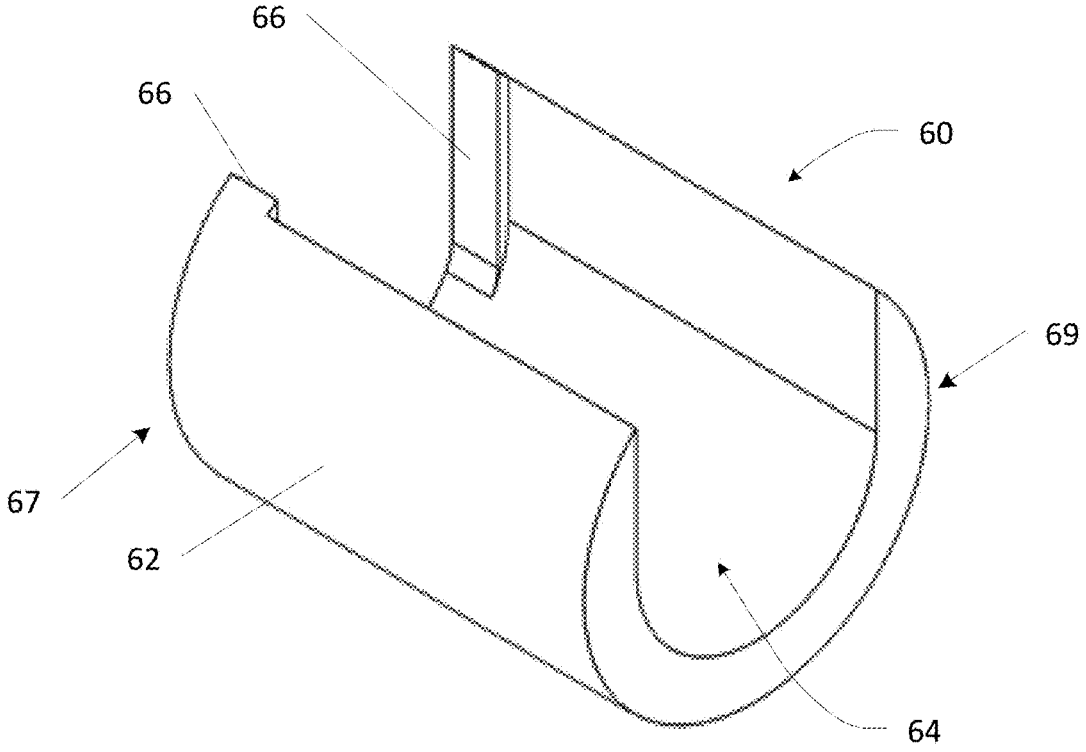
FIG. 5 is an isometric view of a jig according to an example embodiment of the invention.
Figure 6:
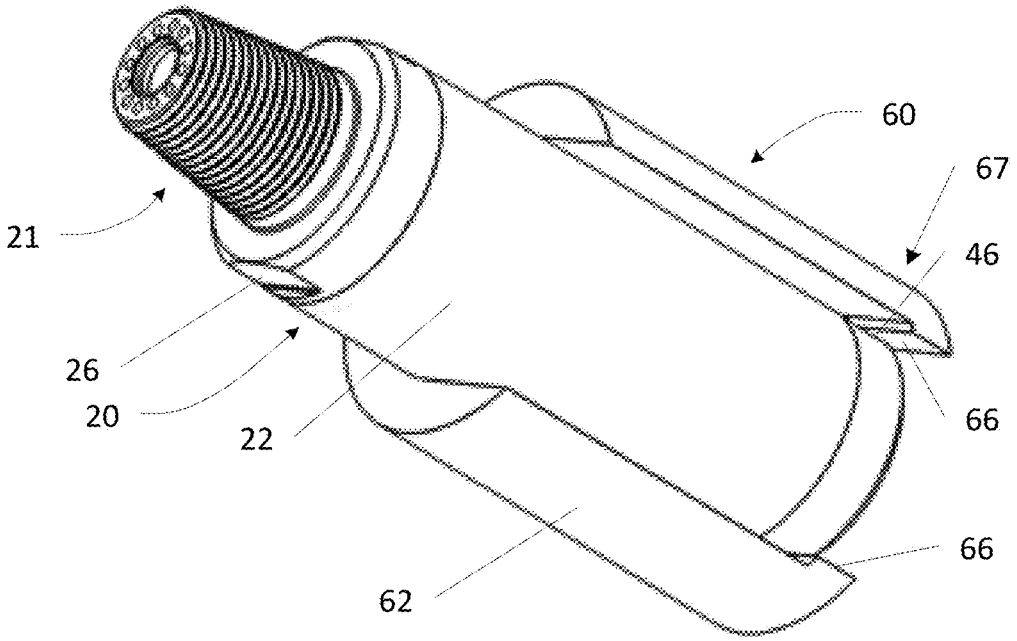
FIG. 6 is an isometric view of the drill pipe shown in FIG. 2 inserted through the jig shown in FIG. 5.

FIG. 5 shows a jig 60 comprising a cylindrical body 62 and cavity 64. Cavity 64 of jig 60 is sized to fit around body 22 of sub 20 as best seen in FIG. 6. In other embodiments, jig 60 may be made in any shape or configuration suitable to fit around body 22 and having an outer surface suitable for being gripped by the tongs or power tongs used for coupling and/or uncoupling uphole drill pipe sections. Body 62 of jig 60 is strong enough not to be crushed when it is gripped and turned by power tongs. In the embodiment shown in FIG. 5, jig 60 further comprises opposed flats 66 defined in the surface defining cavity 64 at a distal end 67 of cylindrical body 62. Flats 66 are complimentarily dimensioned to engage flats 26 of pin 21 and/or flats 46 of box 40. In some embodiments, jig 60 may comprise opposed flats 66 at opposing ends 67, 69 of cylindrical body 62 to engage flats 26 of pin 21 and flats 46 of box 40 simultaneously. In some other embodiments, jig 60 may comprise an array of flats 66 complementarily dimensioned to engage flats 26 and/or 46 of sub 20, as described above. In some embodiments, flats 66 and flats 26 and/or 46 of sub 20 may be augmented by or replaced with complementary holes through which a pin or pins (not shown) may be inserted to secure jig 60 to sub 20.

Figure 7:
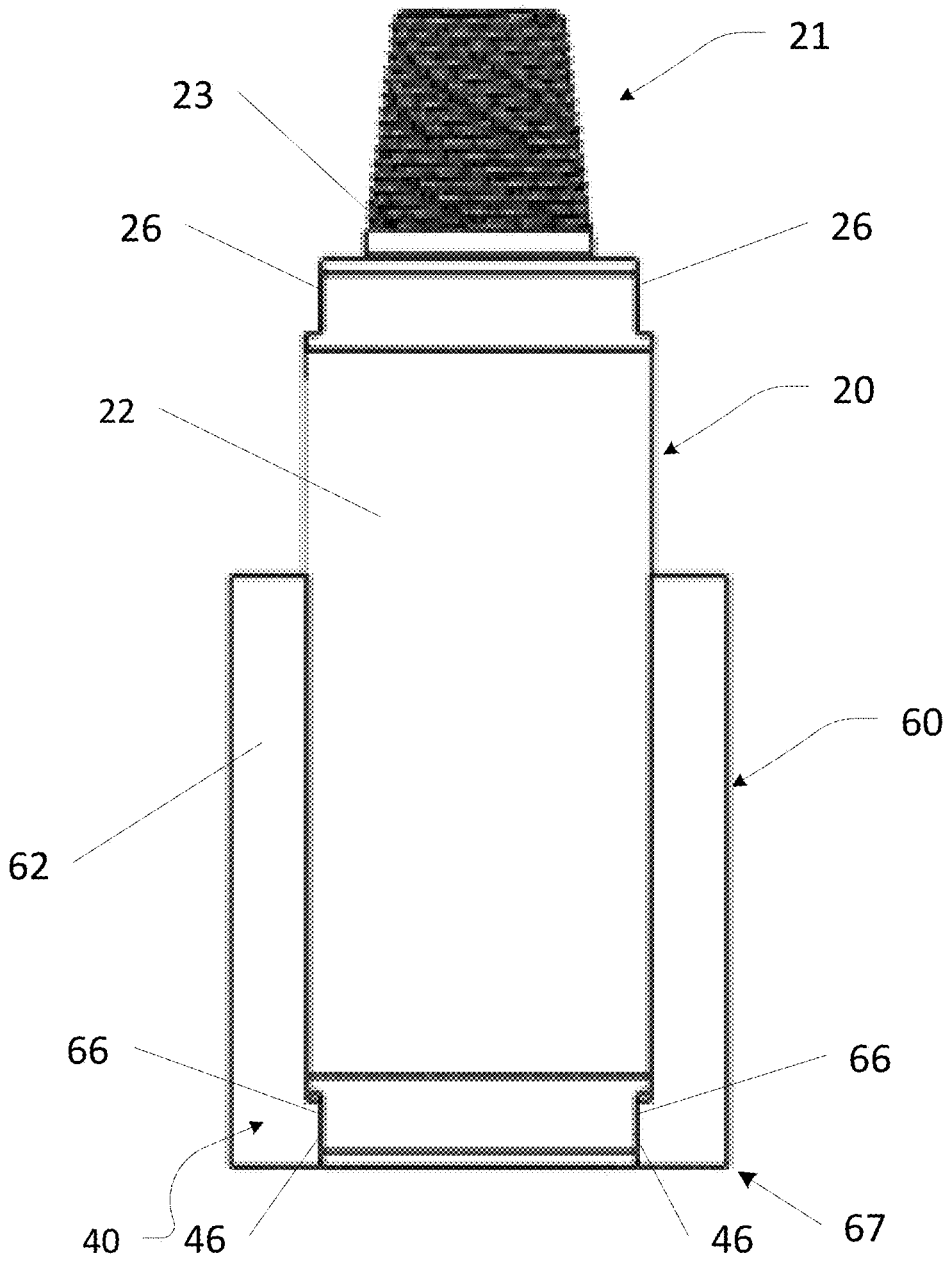
FIG. 7 is a side elevation view of the drill pipe and jig shown in FIG. 6.

Jig 60 can be engaged with the flats 26 and/or 46 of sub 20, wherein cylindrical body 62 extends around body 22 of sub 20. In the embodiment shown in FIGS. 6 and 7, flats 66 of jig 60 engage flats 46 of box 40. For other applications, flats 66 of jig 60 may engage flats 26 of pin 21. In some other embodiments, flats 66 at distal ends 67, 69 of jig 60 engage flats 26 of pin 21 and flats 46 of box 40 simultaneously. In some other embodiments, flats 66 of a first jig 60 engage flats 26 of pin 21 and flats 66 of a second jig 60 engage flats 46 of box 40.

Figure 8:
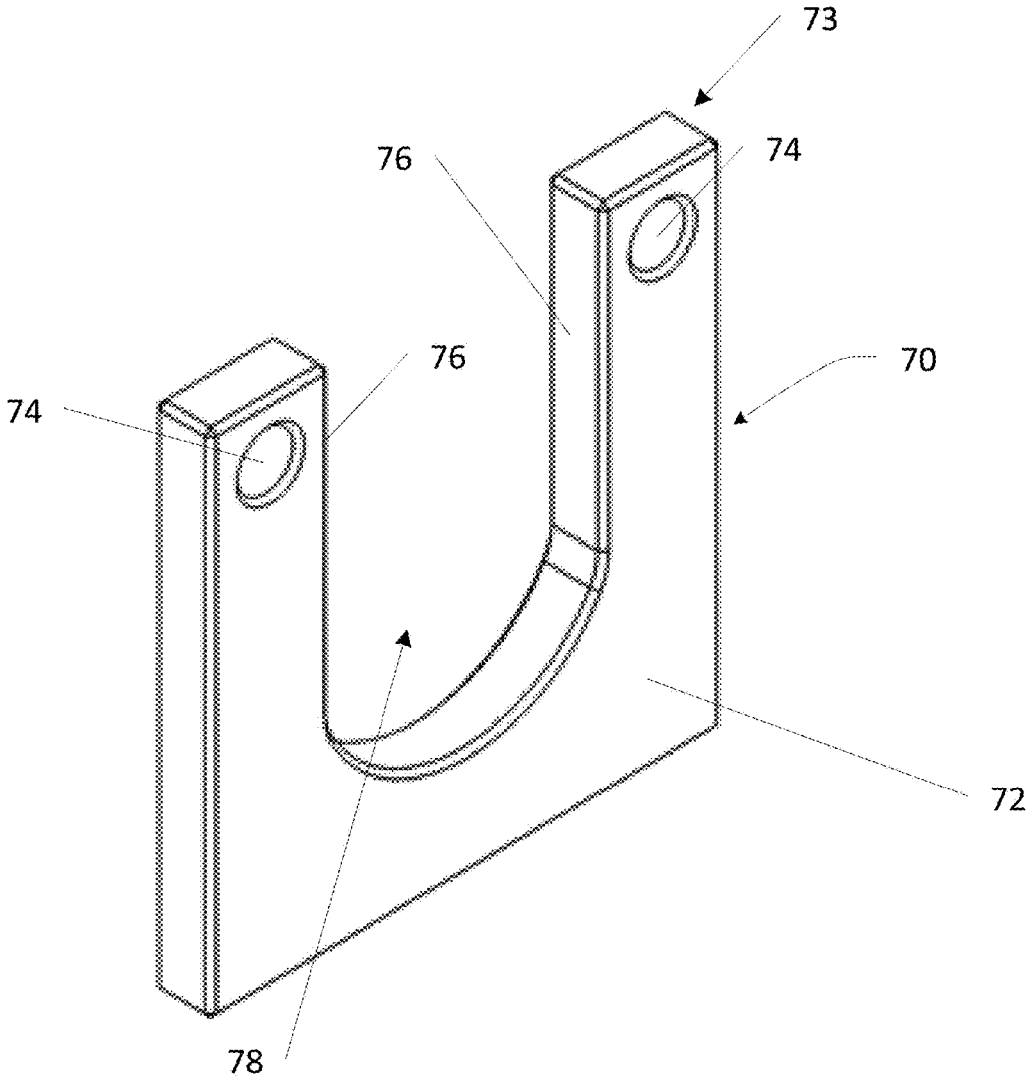
FIG. 8 is an isometric view of a wrench according to an example embodiment of the invention.

FIG. 8 shows a wrench 70 comprising a U-shaped member 72 defining opposed flats 76 and cavity 78. Cavity 78 of wrench 70 is sized to fit around pin 21 and/or box 40. Wrench 70 may be made in any shape or configuration suitable to fit around pin 21 and/or box 40. Wrench 70 is configured to be mounted to a rotary table which may be used for coupling and/or uncoupling uphole drill pipe sections. For example, the outside of wrench 70 may be configured to be gripped by jaws of the rotary table. In alternative embodiments, wrench 70 may comprise pins or other features for non-rotationally engaging the rotary table.

Figure 9:
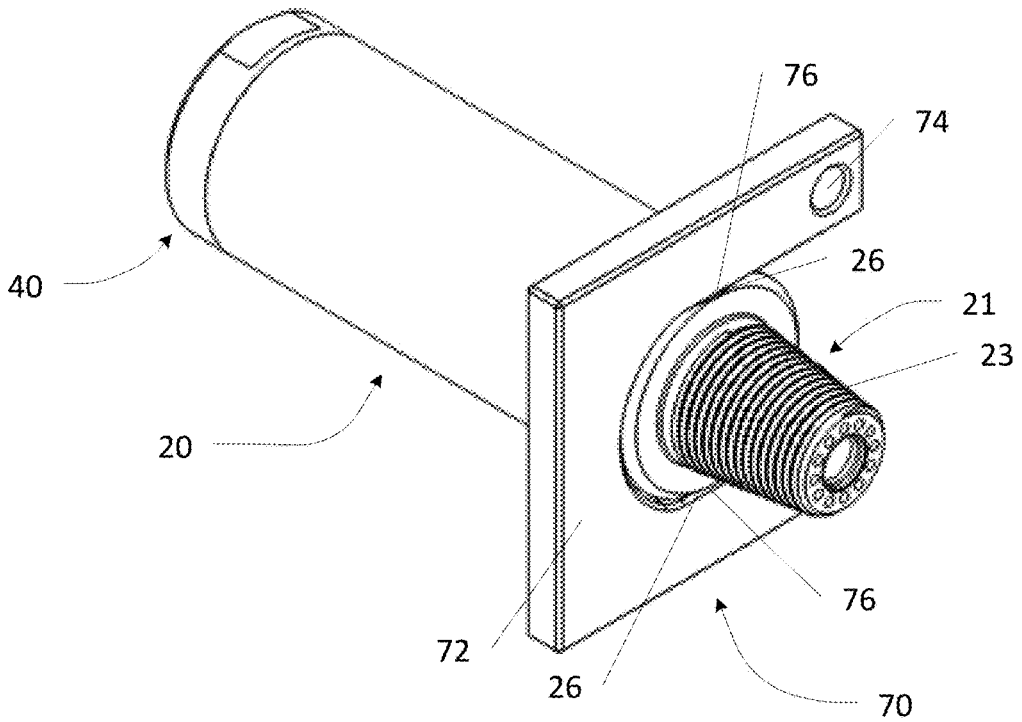
FIG. 9 is a front isometric view of the wrench shown in FIG. 8 fit around the pin shown in FIG. 2.
Figure 10:
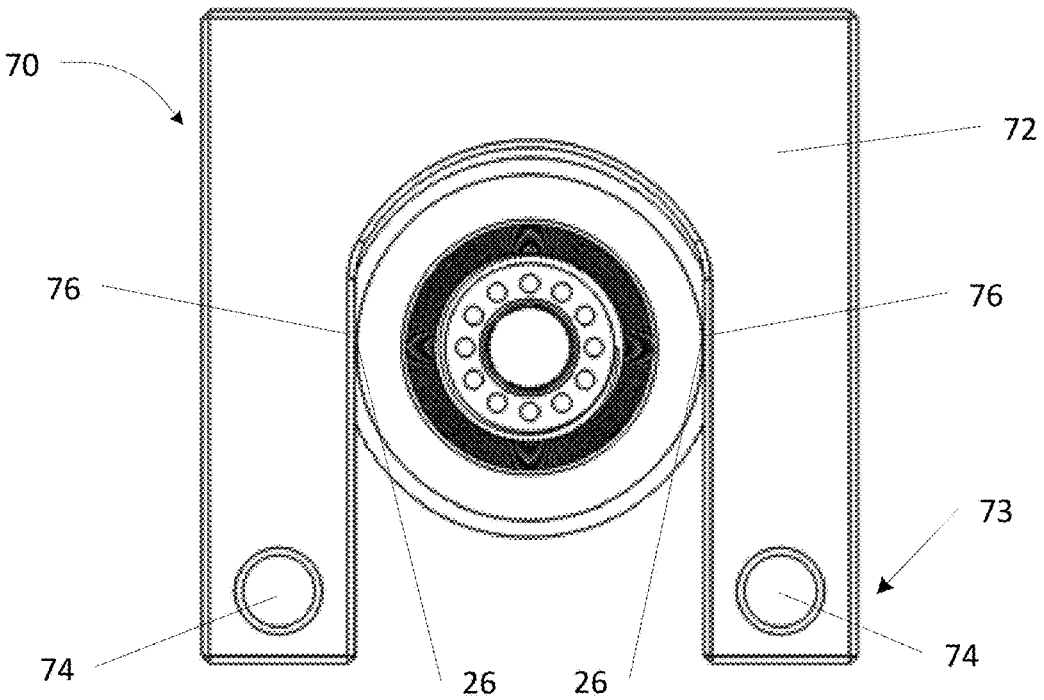
FIG. 10 is a rear view of the wrench and pin shown in FIG. 9.
Figure 11:
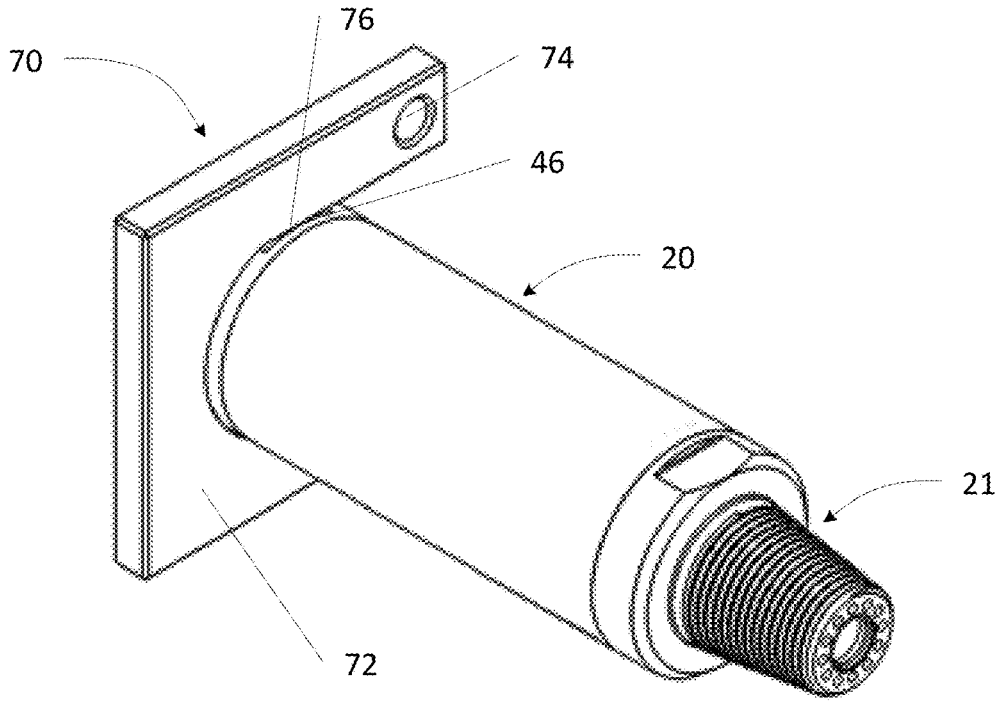
FIG. 11 is a front isometric view of the wrench shown in FIG. 8 fit around the box shown in FIG. 2.
Figure 12:
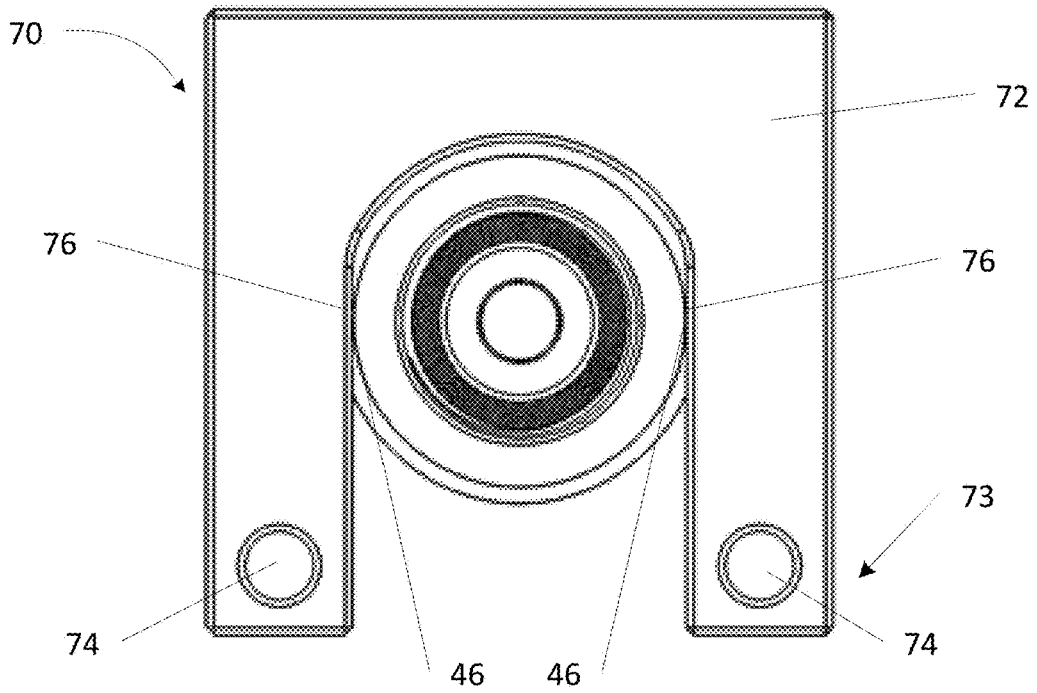
FIG. 12 is a rear view of the wrench and box shown in FIG. 11.
Figure 13:
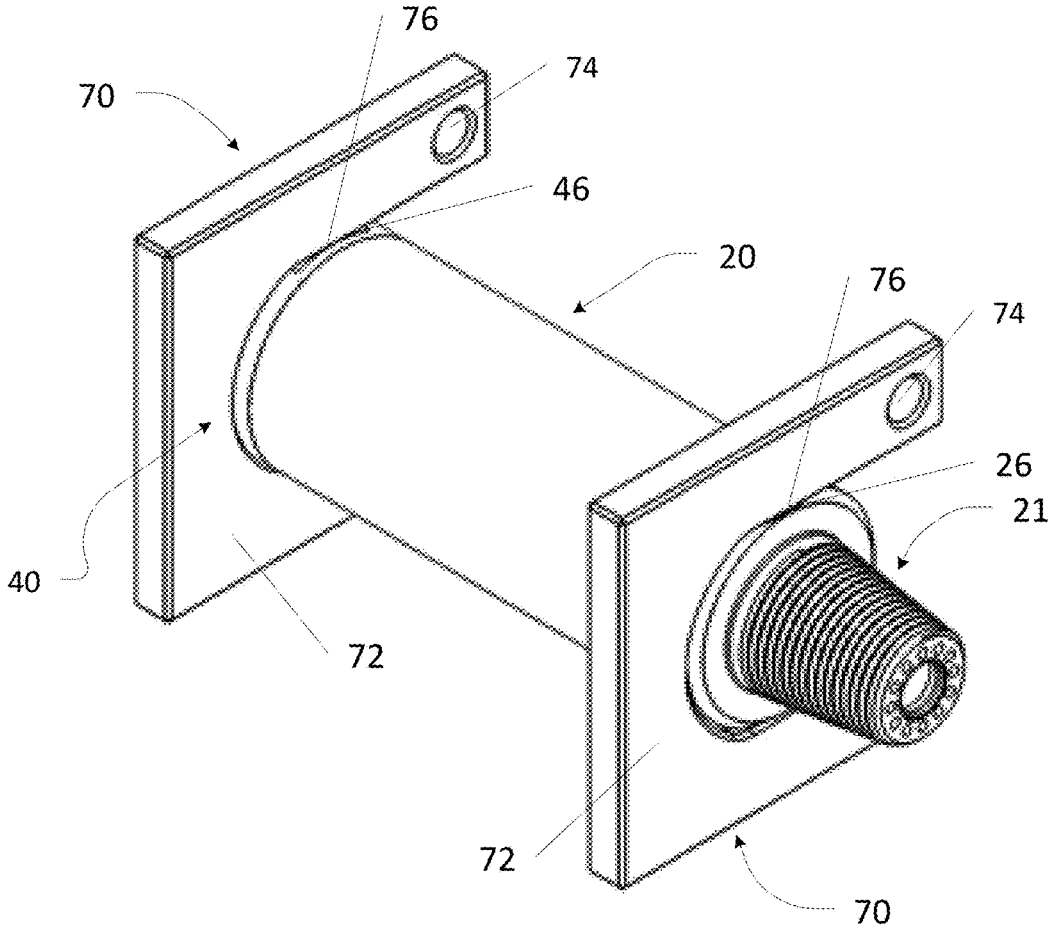
FIG. 13 is a front isometric view showing wrenches like the one shown in FIG. 8, fitted to engage each of the pin and the box shown in FIG. 2.

In the embodiment shown in FIG. 8, U-shaped member 72 defines opposed flats 76 in the surface defining cavity 78. Flats 76 are complimentarily dimensioned to engage flats 26 and/or 46 of sub 20. In some embodiments, wrench 70 may comprise an array of flats 76 complimentarily dimensioned to engage flats 26 and/or 46 of sub 20, as described above. As best seen in FIGS. 9 and 10, pin 21 is inserted into cavity 78 of wrench 70 such that flats 76 engage flats 26 of pin 21. In other embodiments, as best seen in FIGS. 11 and 12, box 40 is inserted into cavity 78 of wrench 70 such that flats 76 engage flats 46 of box 40. In some other embodiments, pairs of wrenches 70 may be engaged with pin 21 and box 40 simultaneously as shown in FIG. 13.

Figure 14:
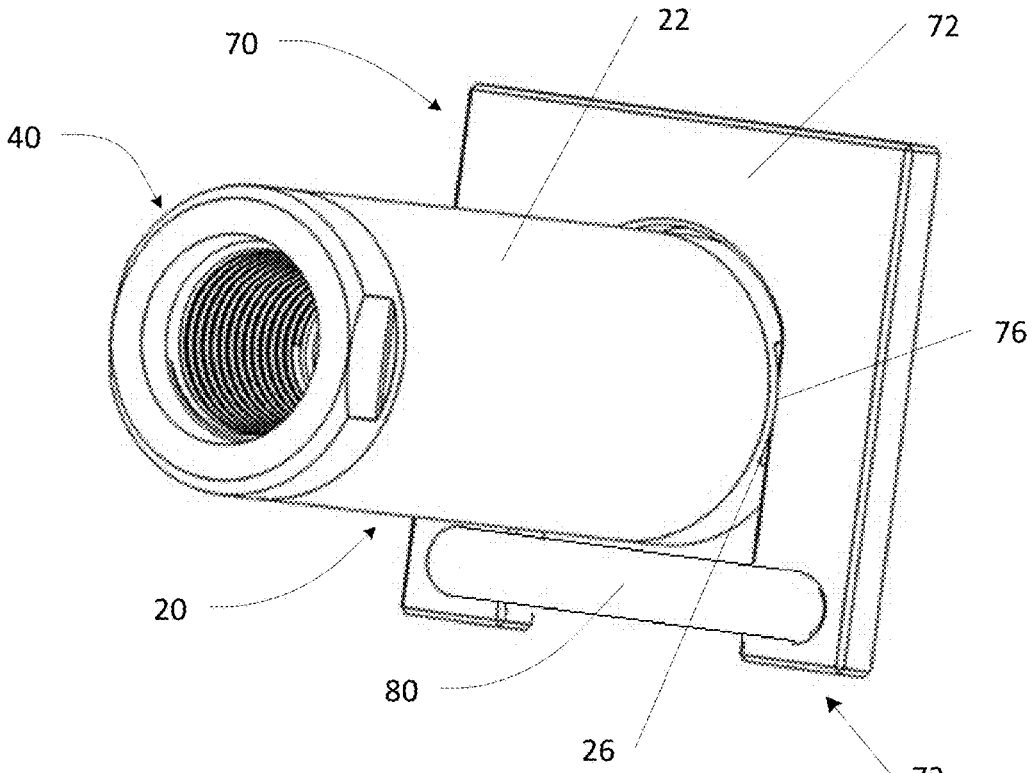
FIG. 14 is a rear isometric view of a wrench according to an example embodiment of the invention fit around the pin shown in FIG. 2.

In some embodiments, U-shaped member 72 includes apertures 74 at a distal end 73 thereof. As best seen in FIG. 14, when pin 21 or box 40 is inserted into cavity 78 of wrench 70, a latch 80 can be engaged with apertures 74 to extend across the opening of cavity 78 thereby preventing pin 21 or box 40 from disengaging from wrench 70 while wrench 70 is being used.

Figure 15:
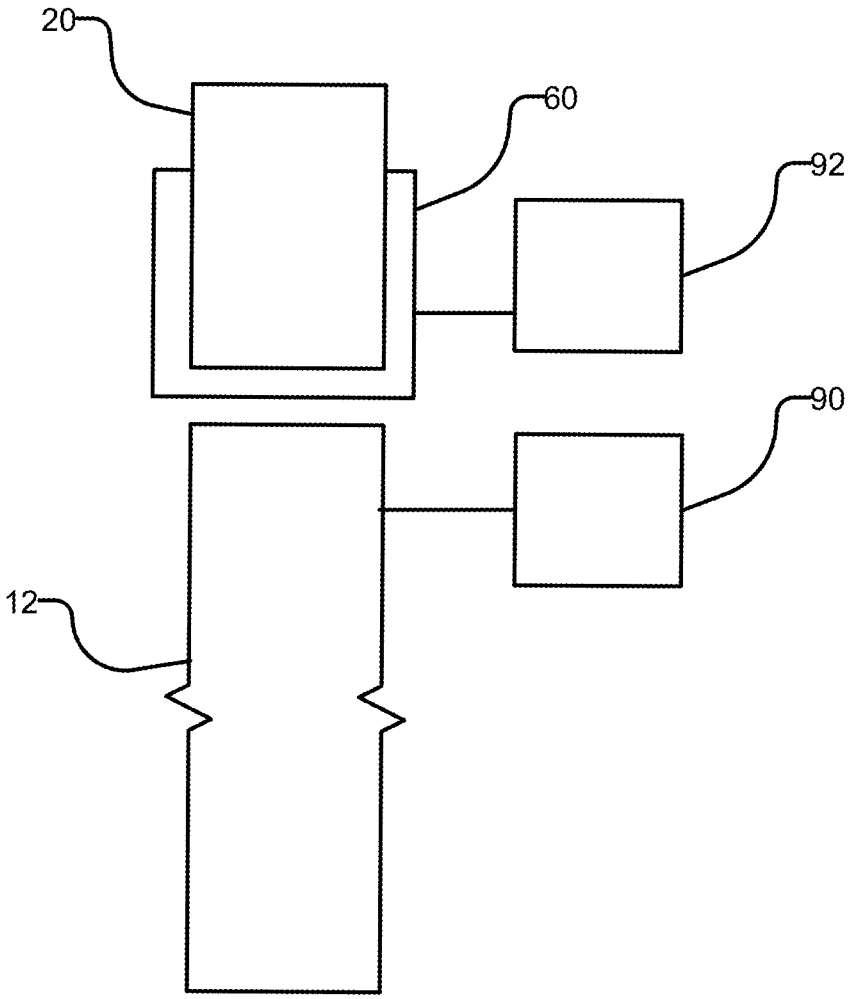
FIG. 15 is a schematic view of first and second torqueing tools used to couple the drill pipe shown in FIG. 2 to a drill string.

To couple sub 20 to the uphole end of a drill string 12, jig 60 is engaged with the coupling at the downhole end of sub 20 (usually pin 21) for example by engagement with flats 26 and/or 46 of sub 20, as discussed above, as shown schematically in FIG. 15. Body 62 of jig 60 extends upwardly and around body 22 of sub 20. The upper end of the drill string 12 is gripped by a rotary table or other torqueing tool 90. Tongs or power tongs or another torqueing tool 92 can then be used to grip body 62 of jig 60 and to torque the downhole coupling of sub 20 to couple sub 20 to the drill string 12. Sub 20 is then at the uphole end of the drill string 12. To add another section to the drill string 12, wrench 70 may be engaged with the uphole coupling of sub 20 (usually box 40). A rotary table (not shown) on rig floor 10B can be used to grip wrench 70. When the rotary table is in a locked position, another drill string section may be torqued onto the uphole coupling of sub 20 using tongs or power tongs and/or rotation of the rotary table. Both of the above operations avoid applying torque between the couplings of sub 20 and the body of sub 20. Thus, loosening or removing the pin or the box from the body is prevented. Further, clamping the tongs directly to body 22 can be prevented to avoid damage to sub 20.

The process may be reversed to remove sub 20 from a drill string. When it is necessary to uncouple a drill string section that is immediately uphole from sub 20, wrench 70 is engaged with the flats of the pin and/or box of the uphole coupling of sub 20. Wrench 70 is gripped in a rotary table. Tongs or power tongs can then be used to grip and unscrew the drill string section from the uphole end of sub 20. To uncouple sub 20 from the uphole end of the drill string, the drill string section immediately downhole from sub 20 is gripped by the rotary table and jig 60 is engaged with the downhole coupling of sub 20. Tongs or power tongs can then be applied to the body 62 of jig 60 to unscrew sub 20 from the drill string.

The wrench and jig as described herein can also be useful in assembling or disassembling sub 20.

Figure 16:
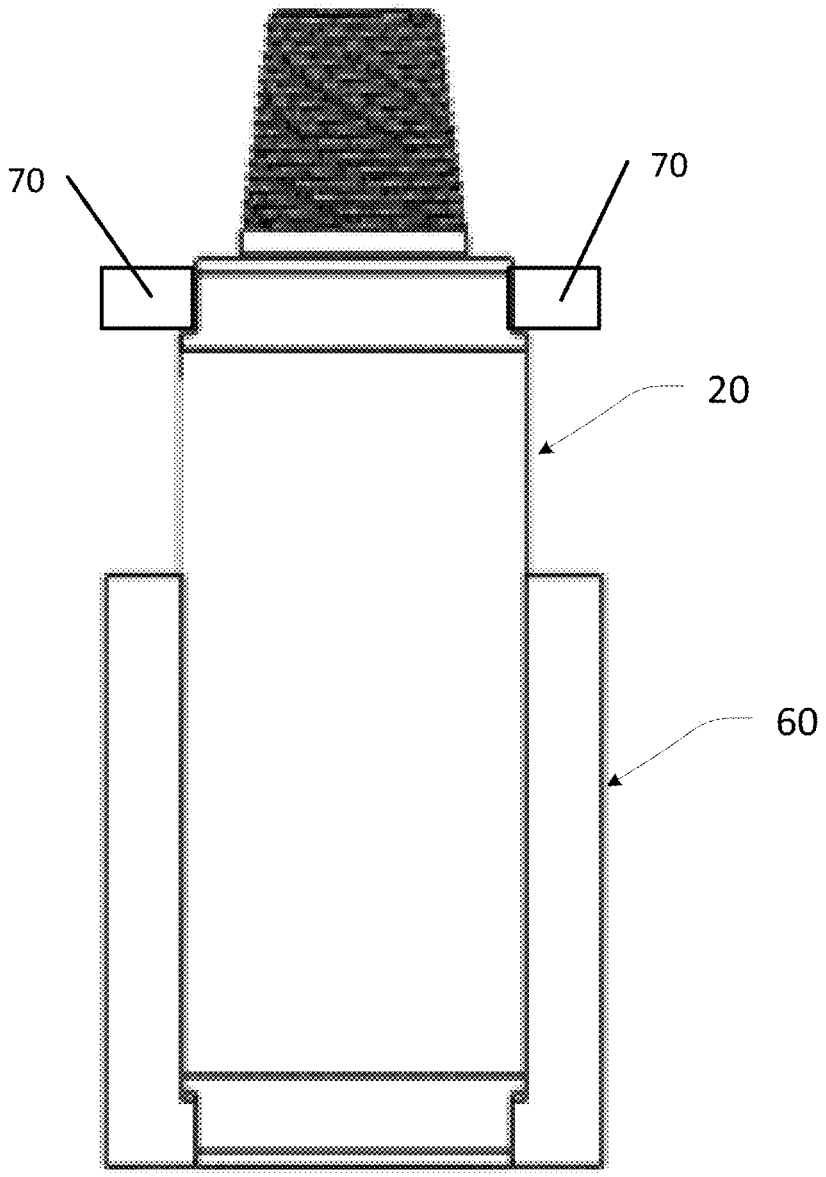
FIG. 16 is a schematic view of the drill pipe shown in FIG. 2 in combination with the jig shown in FIG. 5 and the wrench shown in FIG. 8.

When sub 20 needs to be coupled to a particular uphole section of drill string with a particular type of coupling, pin 21 and/or box 40 with appropriate threads may be selected and connected to body 22. Pin 21 may be removed from body 22 and replaced with a different pin when sub 20 needs to be coupled to a different uphole section of drill string with a different type of coupling. Pin 21 may be removed from body 22, for example, by unscrewing pin 21 from body 22 using wrench 70, jig 60, or any other tool engagement means commonly known in the art. In some embodiments, a rotary table and tongs may be used to disassemble and/or assemble sub 20 on the rig floor. For example, as shown schematically in FIG. 16, wrench 70 may be engaged with a coupling on one end of sub 20. Wrench 70 may be engaged with the rotary table. Jig 60 may be engaged with the coupling on the other end of sub 20. Tongs or power tongs may be engaged with body 62 of jig 60. Torque may be applied by turning the rotary table and/or jig 60 to remove and/or tighten one or both couplings (21, 40) from body 22 of sub 20. In some embodiments, particularly where couplings at both ends of sub 20 are removable, body 22 may be provided with flats or other tool engagement features to facilitate selectively taking off or putting on one of the couplings.

Box 40 with appropriate threads may also be selected and connected to an opposing end of body 22. Box 40 may be removed from body 22 and replaced with a different box 40 when sub 20 needs to be coupled to a different section of drill string with a different type of coupling. Box 40 may be removed from body 22, for example, by unscrewing box 40 from body 22 using wrench 70, jig 60, or any other tool engagement means commonly known in the art.

Interchangeable pin 21 and box 40 allow for replacement of a worn or damaged pin 21 and/or box 40 from body 22 and allow access to any systems inside body 22.

While a number of exemplary aspects and embodiments have been discussed above, those of skill in the art will recognize certain modifications, permutations, additions and sub-combinations thereof.

Interpretation of Terms

Unless the context clearly requires otherwise, throughout the description and the claims:

- "comprise," "comprising," and the like are to be construed in an inclusive sense, as opposed to an exclusive or exhaustive sense; that is to say, in the sense of "including, but not limited to".
- "connected," "coupled," or any variant thereof, means any connection or coupling, either direct or indirect, between two or more elements; the coupling or connection between the elements can be physical, logical, or a combination thereof.
- "herein," "above," "below," and words of similar import, when used to describe this specification shall refer to this specification as a whole and not to any particular portions of this specification.
- "or," in reference to a list of two or more items, covers all of the following interpretations of the word: any of the items in the list, all of the items in the list, and any combination of the items in the list.
- the singular forms "a," "an," and "the" also include the meaning of any appropriate plural forms.

Words that indicate directions such as "vertical," "transverse," "horizontal," "upward," "downward," "forward,"

"backward," "inward," "outward," "vertical," "transverse," "left," "right," "front," "back"," "top," "bottom," "below," "above," "under," "uphole," "downhole," "proximate," "distal," and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A method for torqueing a sub to couple or uncouple the sub to a drill string, the sub comprising a body comprising a first coupling at a first end thereof and a second coupling at a second end thereof opposed to the first end, the method comprising:

coupling a jig to the first coupling of the sub, the jig non-rotationally engaging the first coupling;

engaging a first torqueing tool to an uphole end of the drill string;

engaging a second torqueing tool to an outer surface of the jig;

using one or both of the first and second torqueing tools, rotating the jig and the first coupling relative to the drill string to couple the sub to or uncouple the sub from the uphole end of the drill string; and coupling an additional drill string segment to the second coupling of the sub;

wherein coupling the additional drill string segment to the second coupling of the sub comprises:

non-rotationally engaging a wrench to the second coupling of the sub;

uncoupling the first torqueing tool from the drill string and coupling the wrench to the first torqueing tool;

uncoupling the second torqueing tool from the jig and engaging the additional drill string segment with the second torqueing tool; and using one or both of the first and second torqueing tools, rotating the additional drill string segment relative to the second coupling of the sub to couple the additional drill string segment to or uncouple the additional drill string segment from the sub.

2. A method according to claim 1 wherein the jig comprises a body having a cylindrical outer surface and defines a cavity wherein coupling the jig to the first coupling of the sub comprises introducing at least part of the body of the sub into the cavity of the jig.

3. A method according to claim 1 wherein coupling the jig to the first coupling of the sub comprises engaging opposed flats of the jig to opposed flats on the first coupling of the sub.

4. A method according to claim 3 wherein the first coupling of the sub is removable from the body of the sub.

5. A method according to claim 1 wherein the body of the sub is subjected to no torque while rotating the additional drill string segment relative to the second coupling of the sub.

6. A method according to claim 1 wherein the first torqueing tool comprises a rotary table.

7. A method according to claim 1 wherein the second torqueing tool comprises a rotary table.

8. A method for torqueing a sub to couple or uncouple the sub to a drill string, the sub comprising a body comprising a first coupling at a first end thereof and a second coupling at a second end thereof opposed to the first end, the method comprising:

coupling a jig to the first coupling of the sub, the jig non-rotationally engaging the first coupling;

engaging a first torqueing tool to an uphole end of the drill string;

engaging a second torqueing tool to an outer surface of the jig; and using one or both of the first and second torqueing tools, rotating the jig and the first coupling relative to the drill string to couple the sub to or uncouple the sub from the uphole end of the drill string;

wherein the second coupling of the sub is removable from the body of the sub.

9. A method according to claim 1 wherein the body of the sub is subjected to no torque while rotating the jig and the first coupling relative to the drill string.

* * * * *